US009723419B2

(12) United States Patent
Monks

(10) Patent No.: US 9,723,419 B2
(45) Date of Patent: Aug. 1, 2017

(54) SYSTEMS AND METHODS FOR DETERMINING METRIC FOR SOUND SYSTEM EVALUATION

(71) Applicant: Bose Corporation, Framingham, MA (US)

(72) Inventor: Michael Monks, Concord, MA (US)

(73) Assignee: BOSE CORPORATION, Framingham, MA (US)

( * ) Notice: Subject to any disclaimer, the term of this patent is extended or adjusted under 35 U.S.C. 154(b) by 185 days.

(21) Appl. No.: 14/499,804

(22) Filed: Sep. 29, 2014

(65) Prior Publication Data

US 2016/0094925 A1 Mar. 31, 2016

(51) Int. Cl.
*H04R 29/00* (2006.01)

(52) U.S. Cl.
CPC ..... *H04R 29/001* (2013.01)

(58) Field of Classification Search
CPC ..... G10K 15/00; G10K 11/00; G10K 11/04; G10K 11/16; G10K 11/168; G10K 11/172; H04R 3/12; H04R 1/40; H04R 29/001; H04R 27/00; H04R 2201/021; H04R 2205/024; G01K 15/00; E04B 1/8236; E04B 1/99; E04B 1/994
USPC ..... 381/56, 57, 58, 59, 60, 61, 300–307; 700/94; 181/175, 296, 30; 362/809; 434/131, 284–294; 355/47
See application file for complete search history.

(56) References Cited

U.S. PATENT DOCUMENTS 4,496,022 A * 1/1985 Prohs ..... H04R 1/20 181/175
7,643,640 B2 1/2010 Jorgensen et al.
8,027,483 B2 9/2011 Jorgensen et al.
8,144,883 B2 3/2012 Pedersen
8,150,051 B2 4/2012 Jorgensen et al.
8,311,231 B2 11/2012 Monks et al.
2012/0051568 A1* 3/2012 Kim ..... H04R 1/403 381/307

FOREIGN PATENT DOCUMENTS

JP 0981163 A 3/1997
JP 2010181824 A * 8/2010 ..... G10K 15/00

OTHER PUBLICATIONS

Choi et al "Theories and Signal processing Techniques for the implementation of Sound ball in space using loudspeaker array", Korea Advanced Institute of Science and Technolog, Daejeon, Korea, 2012, pp. 1-6.*

* cited by examiner

*Primary Examiner* — Leshui Zhang

(74) *Attorney, Agent, or Firm* — Schmeiser, Olsen & Watts LLP

(57) ABSTRACT

Provided are a system and method for evaluating sound system performance, comprising: representing an audience space is represented on a surface of a sphere. The sphere has a center that is substantially collocated with a center of a sound system. An efficiency of the sound system is calculated by determining an amount of energy produced by the sound system that reaches the audience space projected onto the sphere relative to a total amount of energy produced by the sound system. A metric is generated for a function by normalizing the efficiency by a ratio of an area of the audience space relative to a total area of the sphere to produce a score for the performance of the sound system.

20 Claims, 6 Drawing Sheets

SYSTEMS AND METHODS FOR DETERMINING METRIC FOR SOUND SYSTEM EVALUATION

BACKGROUND

This description relates generally to sound system design and simulation, and more specifically, to systems and methods for determining metrics for a sound system evaluation in an acoustic environment having an audience listening area.

BRIEF SUMMARY

In a general aspect, provided is a method for evaluating sound system performance, comprising: representing an audience space on a surface of a sphere, the sphere having a center that is substantially collocated with a center of a sound system; calculating an efficiency of the sound system by determining an amount of energy produced by the sound system that reaches the audience space relative to a total amount of energy produced by the sound system; and generating a metric for a function by normalizing the efficiency by a ratio of an area of the audience space projected onto the sphere relative to a total area of the sphere to produce a score for the performance of the sound system.

Aspects may include one or more of the following features:

The score may be output to quantify the performance of the sound system in an audio simulation system.

A total amount of energy produced by the sound system may be determined by: dividing the sphere into substantially equal sized sections, comprising a set of n sample points; for each of the n sample points, calculating an amount of energy from the sound system at that sample point; and summing the amount of energy from the sound system that reaches each of the n sample points.

The sections may be equilateral triangles.

The centers of the triangles may comprise the set of n sample points.

The vertices of the triangles may comprise the set of n sample points.

The sound system may comprise a plurality of electro-acoustic drivers, and calculate the amount of energy from the sound system at each sample point takes into account phase of a signal from each of the plurality of electro-acoustic drivers.

Determining an amount of energy produced by the sound system that reaches the audience space may comprise determining a number m of the n sample points encompassed by the audience space; for each of the m sample points encompassed by the audience space, calculating an amount of energy from the sound system at that sample point; and summing the amount of energy from the sound system that reaches each of the m sample points encompassed by the audience space.

The metric may input to an evaluation function along with other sound system metrics to further quantify the performance of the sound system.

The sound system may be constructed according to the generated metric.

Allocation of the sound system may be determined according to the generated metric.

In accordance with one aspect, provided is computing system that generates a metric term for use in a sound system configuration evaluation function, comprising: an audience space projection module that represents an audience space on a surface of a sphere, the sphere having a center that is substantially collocated with a center of a sound system; a sound system efficiency calculator that calculates an efficiency of the sound system by determining an amount of energy produced by the sound system that reaches the audience space relative to a total amount of energy produced by the sound system; and an efficiency normalization processor that generates a metric for a function by normalizing the efficiency by a ratio of an area of the audience space relative to a total area of the sphere to produce a score for the performance of the sound system.

Aspects may include one or more of the following features:

The sound system efficiency calculator may divide the sphere into substantially equal sized sections, comprising a set of n sample points; for each of the n sample points, calculate an amount of energy from the sound system at that sample point; and sum the amount of energy from the sound system that reaches each of the n sample points.

The sections may be equilateral triangles.

The centers of the triangles may comprise the set of n sample points.

The vertices of the triangles may comprise the set of n sample points.

Sound system efficiency calculator may take into account phase of a signal from each of a plurality of electro-acoustic drivers of the sound system.

In another aspect, provided is a device for simulating a sound system, comprising: an input for receiving sound system data and listening environment data; a storage device for storing the sound system data and listening environment data; and a processor configured to: form a sphere; process the sound system data and the listening environment data to represent an audience space on a surface of a sphere; calculate an efficiency of the sound system by determining an amount of energy produced by the sound system that reaches the audience space relative to a total amount of energy produced by the sound system; and generate a loudspeaker to audience efficiency metric for a function by normalizing the efficiency by a ratio of an area of the audience space relative to a total area of the sphere.

Aspects may include one or more of the following features:

A display that provides a visual representation of the loudspeaker to audience efficiency metric.

An output for outputting the loudspeaker to audience efficiency metric may quantify the performance of the sound system.

BRIEF DESCRIPTION

The above and further advantages may be better understood by referring to the following description in conjunction with the accompanying drawings, in which like numerals indicate like structural elements and features in various figures. The drawings are not necessarily to scale, emphasis instead being placed upon illustrating the principles of features and implementations.

DETAILED DESCRIPTION

A sound system design typically includes considerations related to loudspeaker selection, placement, orientation, and room acoustics. Acoustic environments may vary. For example, a sound speaker design for a personal living space may be different than that of an amphitheater.

In order to determine whether a design is desirable in a particular environment, an acoustic analysis may be performed, for example by taking actual acoustic measurements relating to the performance of the system or by simulating the performance of a system on a computer or similar device. By way of example, an acoustic analysis may indicate that the acoustical response of a loudspeaker positioned at the center of a room is preferable to that of the same loudspeaker positioned at a corner of the room. In formulating such recommendations, complex simulation models are often created.

Figure 1:
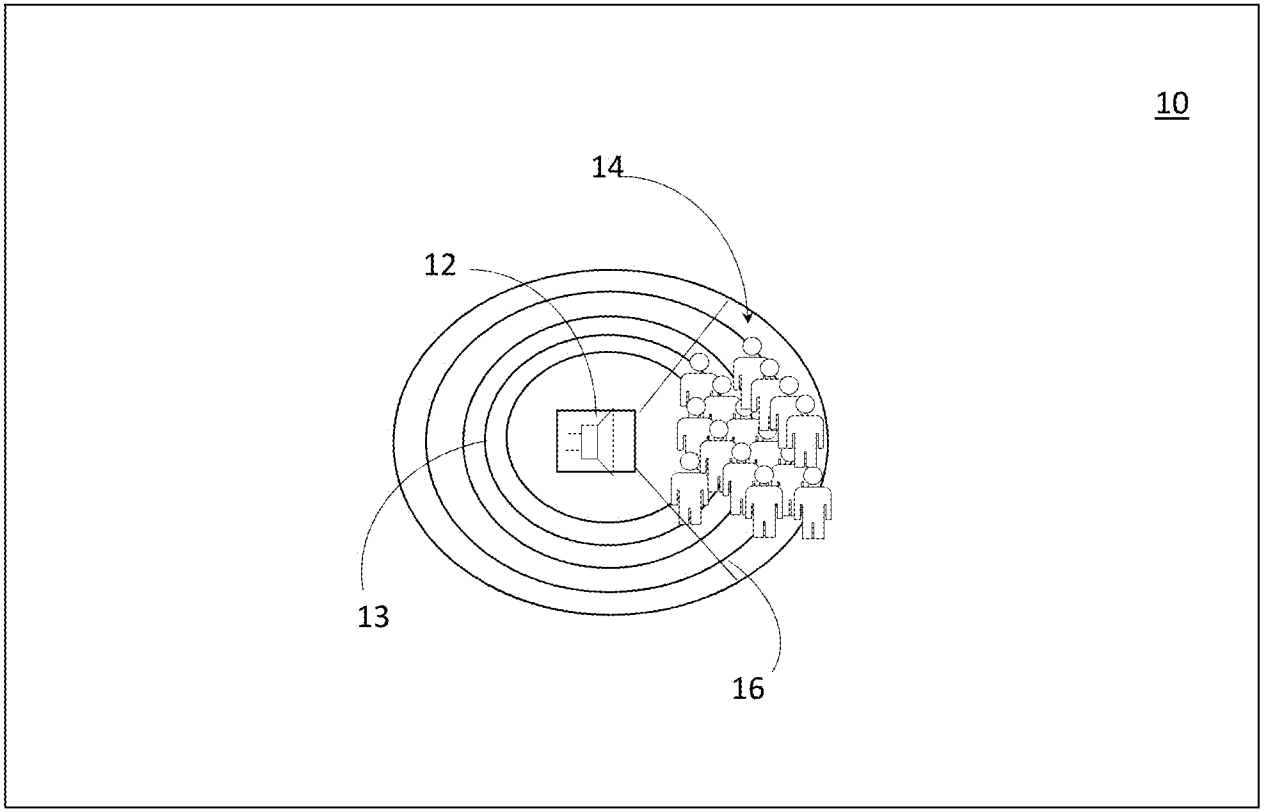
FIG. 1 is a diagrammatic view of a simplified listening environment, in which examples of the present inventive concepts can be practiced.

FIG. 1 is a diagrammatic view of a simplified listening environment 10, in which examples of the present inventive concepts can be practiced.

The simplified listening environment 10 can reduce much of the acoustical complexity of a typical sound system configuration evaluation task. The environment 10 includes a loudspeaker system 12 and an audience area 14. The loudspeaker system 12 outputs audio to a circumferential region 13 about the loudspeaker system 12, shown by concentric circles. A portion of the circumferential region 13 includes the audience area 14. The loudspeaker system 12 can include one or more drivers, clusters, arrays, or other loudspeaker devices. A sound system design and/or simulation may be generated, permitting a user to build a model of at least a portion of the environment 10, to arrange sound system components around or within the environment, and calculate one or more measures of performance of the sound system. The sound system under design and/or simulation can include audio components such as various loudspeaker components or parameters such as loudspeaker type, location in space, orientation, equalization applied, etc., as well as sound environment components such as walls or carpeting, or associated parameters on which performance attributes of the sound system model/sound system design depend. Thus, the loudspeaker 12 can coexist or otherwise communicate with other audio components to form the sound system. Sound environment components may have parameters such as coordinates specifying the physical location in space of the sound environment component, dimensions, acoustic absorption as a function of frequency, and so on. By changing sound system or sound environment components or parameters thereof, and observing the resulting changes to system performance attributes, a sound engineer is able to evaluate the effectiveness of a sound system design or simulation.

The listening environment 10 of FIG. 1 illustrates that direct field energy 16 produced by the loudspeaker system 12 directed toward the audience 14 can be analyzed. More specifically, the percentage of direct field energy 16 produced by the loudspeaker system 12 that arrives at the projected listening audience 14, referred to as loudspeaker to audience efficiency, can be analyzed and can serve as an input to an objective function for a sound system configuration evaluation task, such as the comparison of acoustic quality of multiple sound system configurations. Other factors for comparing acoustic quality of a sound system configuration may include but not be limited to sound pressure level (SPL), coverage uniformity, tonal balance, or related measures known to those of ordinary skill in the art.

Examples of the present inventive concepts provide a less expensive and simplified approach for evaluating sound system performance, by providing a simplified sound environment 10 and a direct sound field for simulation of sound performance when modeling acoustic effects in the environment 10. A value or score can be generated from a determined normalized loudspeaker to audience efficiency, which can be provided as an input for an objective function designed to quantify the performance of the sound system in an audio simulation system.

Figure 2:
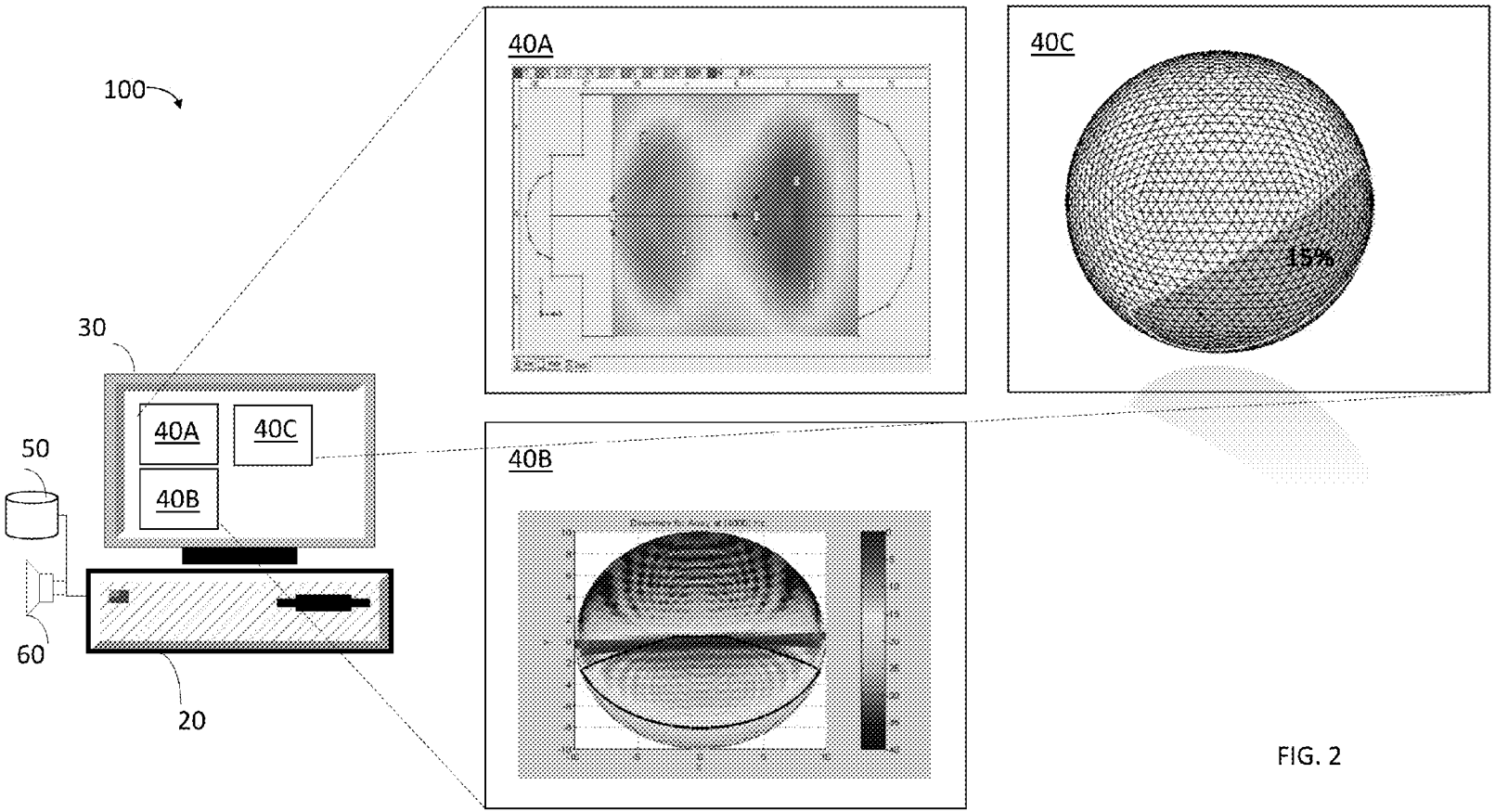
FIG. 2 is a system for sound system design and/or simulation, in accordance with some examples.

FIG. 2 is a system 100 for sound system design and/or simulation, in accordance with some examples. The system 100 can display a sound system model to assist system designers, sound engineers, or other users with selecting loudspeaker components, specifying an acoustic space such as the listening environment 10 of FIG. 1, determining acoustic space parameters, etc. For example, the system 100 can permit a user to design a sound system by observing predictions about the quality of sound in the identified environment 10. After the model is created, the system 100 can perform various acoustic simulations.

The system 100 comprises an input mechanism (not shown), a processor 20 for processing user input received by the input mechanism, a display 30, a storage device 50, and an output device 60 for outputting at least one simulated audio signal.

The input mechanism can include a keyboard, mouse, or other input device known to those of ordinary skill in the art.

The processor 20 performs operations related to the determination of metrics, such as an Audience Q metric described herein, in accordance with some examples. Such metrics can be applied to a sound system evaluation in an acoustic environment, such as the environment 10 described with reference to FIG. 1.

As shown in FIG. 2, the display 30 can display one or more windows or views, including but not limited to a model of a sound system, component parameters, system performance attribute data, graphic representations of a sound system performance attribute, coverage maps, frequency response display, or other displays that may be useful in the design, simulation, and analysis of a sound system.

As shown in FIG. 2, a display window can display a direct field coverage map 40A so that designers can visually evaluate the sound energy that a loudspeaker adds to a room. The map can display sound energy or other performance attribute data. For example, referring again to FIG. 1, the coverage map 40A can display sound pressure levels (SPL) throughout a room 10, in particular, sound energy directed at the listening audience area 14. Another display window can display a loudspeaker directivity graph 40B that displays an amount of directivity exerted radially by the loudspeaker system 12 at a predetermined frequency or band of frequencies.

The display 30 can also display a sphere 40C onto which the audience area 14 is projected, for example, in a simulation. The sphere 40C can be displayed with a tiling or mesh arrangement of triangles or other shapes. The triangles or other shapes may be of approximately equal size. The sphere 40C can correspond to a radius about the loudspeaker system generating the sound for analysis. A user can view the sphere 40C to visually observe an amount of the sphere that is covered by the projected audience area. A boundary line can illustrate the region of the sphere 40C that corresponds with the projected audience area 14 (see FIG. 1). This can be used to calculate a loudspeaker to audience efficiency value, which is a measure of the percentage of direct field energy produced by a loudspeaker system (not shown) at the center of the sphere that arrives at the audience area 14, and a metric such as an Audience Q value, which is the loudspeaker to audience efficiency normalized by the projected area of the audience relative to the total area of the sphere. More specifically, an Audience Q metric as used herein refers to a quality factor, in particular, a measure of an amount of sound energy in the spatial domain with respect to the listening audience direction. The display can therefore provide a visual representation of the loudspeaker to audience efficiency value. This metric can be calculated by determining the ratio of listening area to total area and the ratio of energy directed at the audience to total energy, as described herein. For example, a user may view the sphere 40C and determine that the listening area 14 projected on the sphere covers roughly 15% of the sphere (as shown in FIG. 2), which can then be used to calculate loudspeaker to audience efficiency and other metrics, such as Audience Q, as described herein. The calculation of an Audience Q metric is useful in a loudspeaker design, especially, when the environment is represented only with an audience area, and eliminates the need for a sophisticated sound simulation engine typically used to trace reflected energy.

Figure 3:
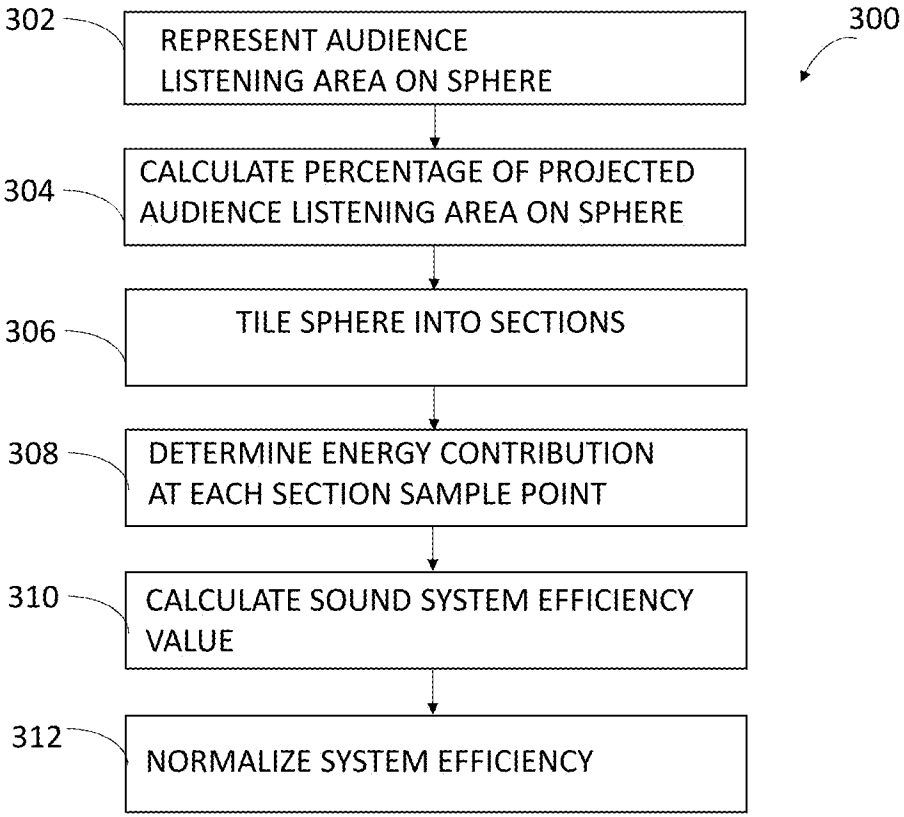
FIG. 3 is a flowchart of a method for determining a metric to measure sound system performance, in accordance with some examples.

FIG. 3 is a flowchart of a method 300 for evaluating sound system performance, in accordance with some examples. The method 300 can be used to evaluate sound system or component performance with respect to an audio simulation system, for example, the Bose® Modeler® software. Alternatively, the method 300 can be applied to an existing loudspeaker, or components of a loudspeaker or other audio device, to test effects of the loudspeaker or other audio device in an environment. In particular, the method 300 can calculate an Audience Q metric or related metric for determining how much energy reaches the listening area and how directed and/or focused that energy is, and can be input to an evaluation function for a model that further evaluates performance of the sound system, as described herein. In some examples, the produced Audience Q metric is weighted along with other metrics that are input to the evaluation function. In particular, the Audience Q metric can inform a sound system designer or other user that sound is reaching a listening area, and how well the sound is directed at the listening area. Although the Audience Q metric is constructed to address direct field energy only, a highly tuned solution can exhibit lower reverberation times and increased intelligibility in the built environment, although such measurements are computationally expensive and require a more complex representation of the environment as well as time-dependent simulation techniques.

In some examples, the method 300 complies with an approach for reducing both acoustic measure and room model complexity. In describing the method 300, reference is made to elements of FIGS. 1 and 2. For example, the method 300 can be applied in the listening environment 10, which includes an audience area 14 and a loudspeaker system 12, and the method 300 can be applied to system 100.

Figure 4:
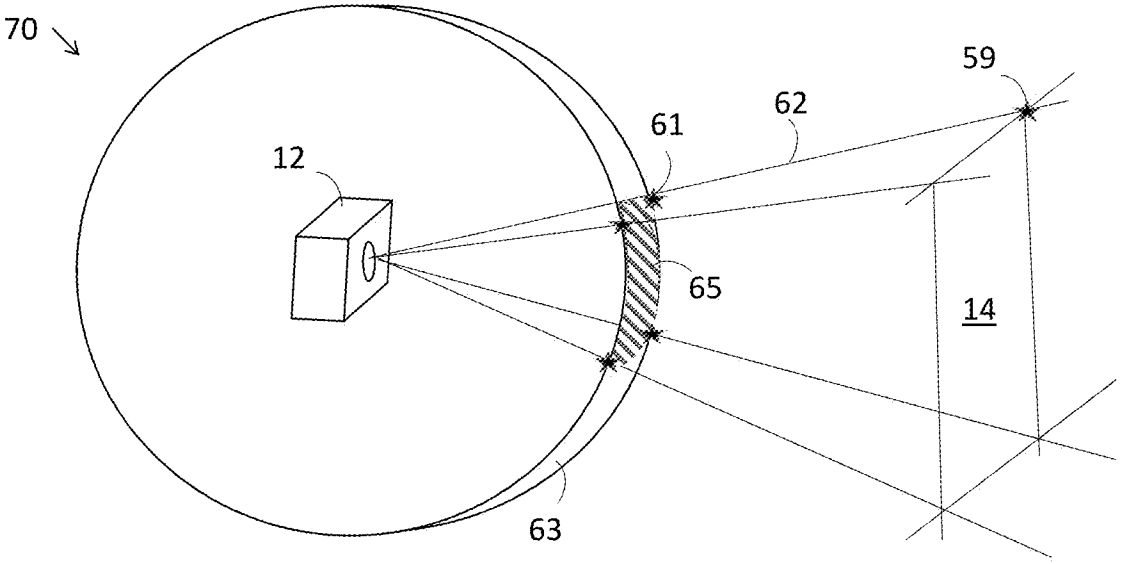
FIG. 4 is a view of lines extending from a listening audience to a sound system approximately in the center of a hypothetical sphere, and points of intersection for forming a pattern of the listening area on the sphere surface, in accordance with some examples.

At block 302, an audience listening area 14 is projected, or represented, on the surface 63 of a sphere 70 (see FIG. 4) having a center that is concentric or otherwise substantially collocated with the center of the loudspeaker system 12. As shown in FIG. 4, this can be achieved by identifying points 59 from the listening area 14, and extending lines 62 from the listening area points 59 to the loudspeaker system 12 approximately in the center of the sphere 70, which intersect the surface 63 of the sphere. The points of intersection 61 correspond to the identified points 59 of the audience listening area 14. Accordingly, points corresponding to various boundaries of the listening area(s) 14 are projected on the surface 63 of the sphere, thereby forming a pattern 65 on the sphere surface 63 that represents the projected listening area. Although a sphere is shown and described, other shapes can equally apply.

At block 304, the percentage of the surface of the sphere 70 occupied by the projected audience listening area is calculated by determining a ratio of the portion 65 of the sphere surface representing the projected listening area and the total sphere surface area.

Figure 5C:
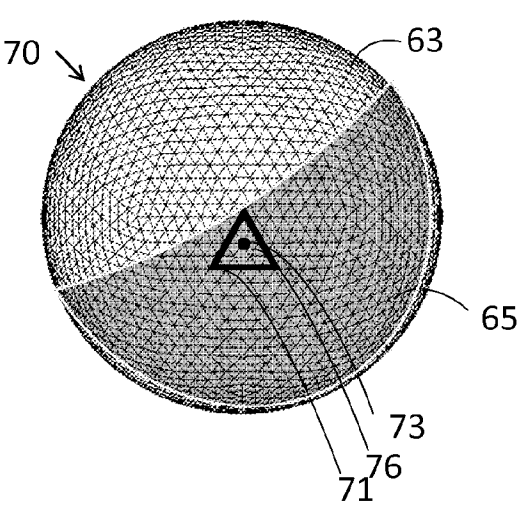
FIG. 5C is a view of a pattern projected on a sphere onto which an audience area is projected, and that is divided into equally sized equilateral triangle segments in order to calculate energy arriving at a sample point at each segment, in accordance with some examples.
Figure 5B:
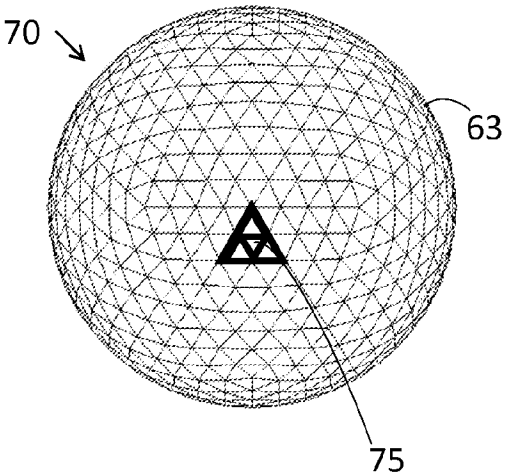
FIGS. 5A and 5B are views of a sphere tiled with equal sized equilateral triangles.
Figure 5A:
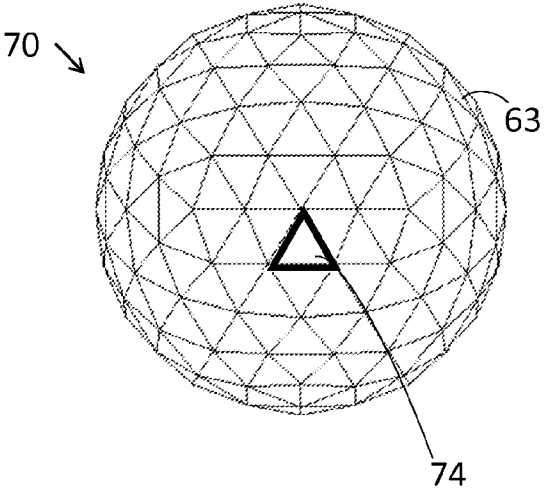

At block 306, the surface 63 of the sphere 70 is divided into sections 71, for example, a mesh of triangles (or other shapes) that may each have an equal area (see FIGS. 5A 5C). In one example, the sphere 70 can be tiled with equal sized equilateral triangles having centers or vertices that define a set of equally spaced sample points. To achieve equal spacing in this manner, a platonic solid may be constructed and arranged as a polyhedron, such as an icosahedron, a dodecahedron, or the like. Each polygon face, for example, each triangular face 74 shown in FIG. 5A, is subdivided into equal triangles 75 (see FIG. 5B). The subdivision process can be repeated until the number of vertices 73, or sample point, of triangles 76 is sufficient for determining an Audience Q metric (see FIG. 5C). The number of triangular sections 74-76 on the surface of the sphere may vary, depending on the desired level of resolution. Accordingly, the spacing between adjacent vertices, or centers of adjacent triangles, is equal, which prevents biasing or other undesirable results during subsequent calculations. Partitioning the sphere is this manner can also be used to determine the amount, for example, percentage, of the sphere 70 that is covered by the projection 65.

At block 308, an energy contribution from the loudspeaker system 12 at each sample point 71 is determined, including points inside the projection pattern 65 and other points on the sphere 70 outside the projection pattern 65. The energy contribution at a point 71 on a sphere can represent an amount of energy from the sound system 12 that reaches that portion of the audience space 14 projected onto the section 71 of the sphere 70. In some examples, the center 73 of the section 71 can be used as a sound field sample point at which the energy contribution is determined. In other examples, each vertex of the triangular sections 71 can be used as a sound field sample point at which the energy contribution is determined. In further examples, other sample points within the sections 71 may be used. The energy arriving at each sample point 73 can be calculated using phase considerations or the like.

For example, the relative array energy arriving at a sample point may be calculated using a summation of the complex contributions of each array. The complex contributions are calculated by taking the loudspeaker, or array, directivity in the direction of the sample, determining phase considerations such as a phase offset based on the distance between the system and the sample point and including any additional delay applied to that system, and scaled by any additional gain applied. The relative array energy is determined because distance effects to the amplitude are ignored since all sample points are treated as if they are the same distance from the array. The energy contributions at the sample points 73 within the projected audience area 65 are summed to determine the amount of direct field energy produced by the loudspeaker system 12 that arrives at the audience area 14. In addition, the energy contributions at the sample points 73 that are outside the projected audience area 65 are also summed, to determine the amount of direct field energy produced by the loudspeaker system 12 that does not arrive at the audience area 14. The energy contribution at each point 73 within the projected audience area 65 can contribute to an overall direct field energy amount produced by the loudspeaker system 12 that arrives at the audience 14, and is an input in calculating the efficiency of the sound system.

At block 310, a sound system efficiency value is calculated for determining a proportion of energy produced by the sound system that is received by the listening area, in particular, by determining a ratio of the amount of energy produced by the sound system that reaches the audience listening area and a total amount of energy produced by the sound system. This can be achieved by adding the amount of energy contribution at each section 71 of the sphere 70, more specifically, a vertex or other point in the section 71 such as sample points 61 on the sphere shown in FIG. 4 corresponding to the projected listening area 65, and dividing the resulting number by the total amount of energy contribution at the sphere 70. The energy contribution can be simulated, measured or otherwise determined by sensors or other well-known techniques. Any data set could be used, simulated or measured, so long as it satisfies the equal distance/equally spaced requirements described herein. Alternatively, the values at these sample point locations can be derived by interpolation from a non-uniform sampling.

At block 312, the system efficiency determined in block 310 is normalized, i.e., resulting in an Audience Q metric, by dividing the sound system efficiency value calculated in block 310 by a ratio of samples in the projected audience area 65 to total samples across the entire sphere. The tiling of the sphere with equal sized equilateral triangles permits the Audience Q value to be determined by a ratio of sample points to be determined as an alternative to the processor-intensive calculation of determining a ratio of projected audience area to total sphere area. In embodiments where the mesh about the sphere comprises unequal sized triangles or other shapes, an Audience Q value can be determined according to a ratio of projected audience area to total sphere area.

Accordingly, a feature is that Audience Q values can be calculated by tiling a sphere with equally sized equilateral triangles whose centers, or optionally, vertices, represent a set of equally spaced sample points. The equal spacing of the points reduces the complexity by obviating the need for weighting each sample to the area of its non-uniform segment. This also allows a calculation to be performed that includes the ratio of the number of sample points within the audience boundary and the total number of samples.

As will be appreciated by one skilled in the art, aspects of the concepts described herein, including the method 300, may take the form of an entirely hardware implementation, an entirely software implementation (including firmware, resident software, micro-code, etc.) or an implementation combining software and hardware aspects. Accordingly, some or all of the blocks of the flowchart can be implemented by computer program instructions. These computer program instructions may be provided to a processor of a programmable data processing apparatus to produce a machine, such that the instructions, which are stored in memory and execute via the processor of the computer or other programmable data processing apparatus, implement the functions specified in the method 300.

Figure 6:
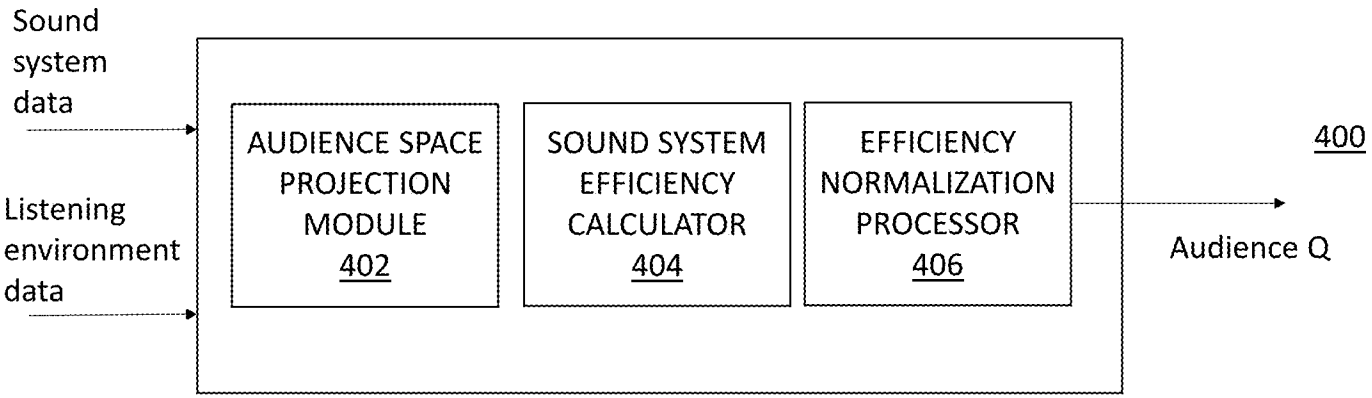
FIG. 6 is a block diagram of a computing system that generates a metric term for use in a sound system configuration evaluation function, in accordance with some examples.

FIG. 6 is a block diagram of a computing system 400 that generates a metric term for use in a sound system configuration evaluation function, in accordance with some examples. Some or all of the method 300 can be performed on the computing system 400. Some or all of the computing system 400 is implemented in a hardware device having at least a processor and a memory, for example, processor 20 and storage 50 of FIG. 2.

The computing system 400 comprises an audience space projection module 402, a sound system efficiency calculator 404, and an efficiency normalization processor 406.

The audience space projection module 402 generates data corresponding to the dimensions of a sphere (e.g., 70) centered about a sound system such as a driver or related audio device, including area, circumference, distance from the audio device, and so on. The sound system to which the inventive concepts can be applied can include a simulated sound system or an actual sound system. The sphere is divided into a plurality of sections, for example, equal sized equilateral triangular sections (see block 306 above). The audience space projection module 402 also projects, or represents, an audience listening area about the periphery of the generated sphere, for example, in a manner similar to or the same as described herein. Accordingly, some the sections are inside the projected audience listening area, and other sections are outside the projected audience listening area. Thus, a percentage of the sphere covered by the audience listening area projection can be determined.

The efficiency calculator 404 calculates an efficiency of the sound system by determining an amount of energy produced by the sound system that reaches the audience space relative to a total amount of energy produced by the sound system. This can be achieved by receiving an input of listening environment data such as direct field energy produced by the sound system directed toward the audience. For each section (e.g., 71) of the sphere, an amount of energy is calculated from the sound system that reaches the section, for example, in a manner similar to or the same as described herein. In examples where the sound system includes an array, an energy contribution can be collected for the array considering cancellation due to array effects.

The efficiency normalization processor 406 generates a metric, in particular, an Audience Q metric, by normalizing the efficiency, for example by dividing the efficiency by a ratio of an area of the audience space relative to a total area of the sphere, to produce an overall score for the performance of the sound system. The Audience Q metric can be output to an evaluation or objective function or the like which may weigh the Audience Q metric relative to other metrics of interest (e.g., sound pressure level, coverage uniformity, tonal balance, and so on) and provide an overall score for the performance of the sound system. Within the evaluation function, the metrics could be weighted equally or differently according to a user's design goals. Thus, the Audience Q metric and any evaluation function that it feeds can form the basis for sound system or component design optimization.

Devices, systems, and methods herein may be extended to include sound systems composed of multiple subsystems (e.g. multiple drivers, arrays, clusters, or other loudspeaker devices) and environments composed of multiple audience areas. For each loudspeaker subsystem, its target listening area is identified, and an Audience Q value is calculated for the subsystem/audience pair, e.g., according to a sphere for each array. The resulting set of values (which can be weighted by the power supplied to each subsystem) can be combined, and optionally, weighted by the listening area serviced by each subsystem. The overall Audience Q value for the multiple driver system can then be used to compare and evaluate different design solutions.

Embodiments of the systems and methods described above comprise computer components and computer-implemented steps that will be apparent to those skilled in the art. For example, it should be understood by one of skill in the art that the computer-implemented steps may be stored as computer-executable instructions on a computer-readable medium such as, for example, floppy disks, hard disks, optical disks, Flash ROMS, nonvolatile ROM, and RAM. Furthermore, it should be understood by one of skill in the art that the computer-executable instructions may be executed on a variety of processors such as, for example, microprocessors, digital signal processors, gate arrays, etc. For ease of exposition, not every step or element of the systems and methods described above is described herein as part of a computer system, but those skilled in the art will recognize that each step or element may have a corresponding computer system or software component.

A number of implementations have been described. Nevertheless, it will be understood that the foregoing description is intended to illustrate and not to limit the scope of the inventive concepts which are defined by the scope of the claims. Other examples are within the scope of the following claims.

What is claimed is:

1. A method for evaluating a sound system performance, comprising:

representing an audience space on a surface of a sphere, including:

identifying points from an audience listening area of the audience space;

extending lines from the points from the audience listening area to a sound system, the sphere having a center that is substantially collocated with a center of the sound system;

positioning points of intersection of the extended lines on the sphere which correspond to a boundary of the audience listening area projected on the surface of the sphere;

forming a pattern on the surface of the sphere that represents the projected audience listening area; and dividing the surface of the sphere into sections, each section within the boundary of the audience listening area projected on the surface of the sphere having a sound field sample point, the sound field sample points in the sections equally spaced apart from each other;

calculating an efficiency of the sound system by determining an amount of energy produced by the sound system that reaches the audience space relative to a total amount of energy produced by the sound system by determining an energy contribution at each equally spaced sound field sample point, wherein the energy arriving at the surface of the sphere includes a relative array direct field energy produced by the sound system;

generating a metric for a function by normalizing the efficiency by a ratio of an area of the pattern on the surface of the sphere that represents the projected audience listening area relative to a total area of the sphere, the metric used to measure of an amount of sound energy in a spatial domain with respect to a listening audience direction of the audience space; and applying the metric to an objective function designed to quantify the performance of the sound system in an audio simulation system and to modify at least one of a design of the sound system, components of the sound system, or sound environment components so that the sound system outputs acoustics controlled according to the modified design.

2. The method of claim 1, further comprising outputting the metric to quantify the sound system performance in the audio simulation system.

3. The method of claim 1, wherein a total amount of energy produced by the sound system is determined by:

dividing the sphere into substantially equal sized sections, comprising identifying a set of n sample points from the substantially equal sized sections;

for each of the n sample points, calculating an amount of energy including the energy contribution from the sound system at the each of the n sample points; and summing the amount of energy from the sound system that reaches each of the n sample points.

4. The method of claim 3, wherein the equalized sections are equilateral triangles.

5. The method of claim 4, wherein centers of the equilateral triangles comprise the set of n sample points.

6. The method of claim 4, wherein the vertices of the equilateral triangles comprise the set of n sample points.

7. The method of claim 3, wherein the sound system comprises a plurality of electro-acoustic drivers, and calculating the amount of energy from the sound system at each sample point takes into account phase of a signal from each of the plurality of electro-acoustic drivers.

8. The method of claim 3, wherein determining the amount of energy produced by the sound system that reaches the audience space comprises:

determining a number m of the n sample points encompassed by the audience space;

for each of the m sample points encompassed by the audience space, calculating an amount of energy from the sound system at the each of the m sample points; and summing the amount of energy from the sound system that reaches each of the m sample points encompassed by the audience space.

9. The method of claim 1, wherein the metric is input to an evaluation function along with other sound system metrics to further quantify the sound system performance.

10. The method of claim 1, further comprising:

constructing the sound system according to the generated metric.

11. The method of claim 1, further comprising:

determining a location of the sound system according to the generated metric.

12. A computing system that generates a metric term for use in a sound system configuration evaluation function, comprising:

a programmable data processing apparatus for an audience space representation that generates data corresponding to dimensions of a sphere centered around a sound system, for representing an audience space on a surface of the sphere, including identifying points from an audience listening area of the audience space, extending lines from the points from the audience listening area to a sound system, positioning points of intersection of the extended lines on the sphere which correspond to a boundary of the audience listening area projected on the surface of the sphere, forming a pattern on the surface of the sphere that represents the projected audience listening area; and dividing the surface of the sphere into sections, each section within the boundary of the audience listening area projected on the surface of the sphere having a sound field sample point, the sound field sample points in the sections equally spaced apart from each other;

a sound system efficiency calculator executed by a programmable data processing apparatus that calculates an efficiency of the sound system by determining an amount of energy produced by the sound system that reaches the audience space relative to a total amount of energy produced by the sound system by determining an energy contribution at each equally spaced sound field sample point, wherein the energy arriving at the surface of the sphere includes a relative array energy; and an efficiency normalization processor of a programmable data processing apparatus that generates a metric for a function by normalizing the efficiency by a ratio of an area of the audience space relative to a total area of the sphere, the metric used to measure of an amount of sound energy in a spatial domain with respect to a listening audience direction of the audience space, wherein the metric is applied to an objective function designed to quantify the performance of the sound system in an audio simulation system and to modify at least one of a design of the sound system, components of the sound system, or sound environment components so that the sound system outputs acoustics controlled according to the modified design.

13. The computing system of claim 12, wherein the sound system efficiency calculator:

divides the sphere into substantially equal sized sections, comprising a set of n sample points;

for each of the n sample points, calculates an amount of energy from the sound system at that sample point; and sums the amount of energy from the sound system that reaches each of the n sample points.

14. The computing system of claim 13, wherein the sections are equilateral triangles.

15. The computing system of claim 14, wherein the centers of the triangles comprise the set of n sample points.

16. The computing system of claim 14, wherein the vertices of the triangles comprise the set of n sample points.

17. The computing system of claim 12, wherein sound system efficiency calculator takes into account phase of a signal from each of a plurality of electro-acoustic drivers of the sound system.

18. A device for simulating a sound system, comprising:

an input for receiving data corresponding to dimensions of a sphere and listening environment data;

a storage device for storing the data corresponding to dimensions of a sphere and listening environment data; and a processor of a programmable data processing apparatus configured to:

form the sphere using the data corresponding to the dimensions of the sphere;

represent an audience space on a surface of the sphere using the listening environment data, including:

identifying points from an audience listening area of the audience space;

extending lines from the points from the audience listening area to a sound system;

positioning points of intersection of the extended lines on the sphere which correspond to a boundary of the audience listening area projected on the surface of the sphere;

forming a pattern on the surface of the sphere that represents the projected audience listening area; and dividing the surface of the sphere into sections, each section within the boundary of the audience listening area projected on the surface of the sphere having a sound field sample point, the sound field sample points in the sections equally spaced apart from each other;

calculate an efficiency of the sound system by determining an amount of energy produced by the sound system that reaches the audience space relative to a total amount of energy produced by the sound system by determining an energy contribution at each equally spaced sound field sample point, wherein the energy arriving at the surface of the sphere includes a relative array energy;

generate a loudspeaker-to-audience efficiency metric for a function by normalizing the efficiency by a ratio of an area of the audience space relative to a total area of the sphere the metric used to measure of an amount of sound energy in a spatial domain with respect to a listening audience direction of the audience space; and apply the metric to an objective function designed to quantify the performance of the sound system in an audio simulation system and to modify at least one of a design of the sound system, components of the sound system, or sound environment components so that the sound system outputs acoustics controlled according to the modified design.

19. The device of claim 18, further comprising a display that provides a visual representation of the loudspeaker-to-audience efficiency metric.

20. The device of claim 18, further comprising an output for outputting the loudspeaker-to-audience efficiency metric to quantify the performance of the sound system.

* * * * *